US006916191B2

(12) United States Patent
McAlonis

(10) Patent No.: US 6,916,191 B2
(45) Date of Patent: Jul. 12, 2005

(54) CONNECTOR ASSEMBLY FOR MONITORING PRINTER INK

(75) Inventor: Matthew Richard McAlonis, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/670,658

(22) Filed: Sep. 25, 2003

(65) Prior Publication Data

US 2004/0087197 A1 May 6, 2004

Related U.S. Application Data

(60) Provisional application No. 60/417,799, filed on Oct. 11, 2002.

(51) Int. Cl.[7] ..... H01R 4/64

(52) U.S. Cl. ..... 439/191; 439/190

(58) Field of Search ..... 439/190, 191, 439/194, 909; 347/74, 25, 177, 85, 7, 86, 87, 43; 340/605; 73/861.11, 861.12, 861.08, 861.13, 12; 417/53

(56) References Cited

U.S. PATENT DOCUMENTS

| | | | | | |
|---|---|---|---|---|---|
| 5,269,191 | A | * | 12/1993 | Wada | 73/861.12 |
| 5,417,119 | A | * | 5/1995 | Smoll | 73/861.12 |
| 5,685,698 | A | * | 11/1997 | Smoll | 417/50 |
| 6,568,790 | B1 | * | 5/2003 | Sugiyama | 347/43 |
| 6,702,433 | B2 | * | 3/2004 | Kono | 347/85 |

* cited by examiner

*Primary Examiner*—Alexander Gilman

(57) ABSTRACT

An electrical connector includes at least one body having a passageway for a flow of a conductive fluid. A first conductive pin is in fluid communication with the passageway, and a second conductive pin is in fluid communication with the passageway, wherein a conductive path is established through the conductive ink between the first and conductive pins when the conductive fluid flows through the passageway.

23 Claims, 19 Drawing Sheets

CONNECTOR ASSEMBLY FOR MONITORING PRINTER INK

CROSS REFERENCE TO RELATED APPLICATIONS

This application claims the benefit of U.S. Provisional Application Ser. No. 60/417,799 filed Oct. 11, 2002 which is hereby incorporated by reference in its entirety.

BACKGROUND OF THE INVENTION

The present invention generally relates to a connector for monitoring the flow of conductive fluid. More particularly, the present invention relates to a tube carrying contact pins that form an electrical circuit with conductive printer ink flowing through the tube.

A typical inkjet printer includes an ink cartridge that receives electrical signals to dispense certain colors and amounts of ink onto paper in particular patterns. The ink cartridge includes a printer pen connected to an ink reservoir. The printer sends an electrical signal or "hit" to the printer pen to dispense the desired amount and color of ink. The printer pen draws ink from the ink reservoir to perform the job. The printer monitors the levels of ink left in the ink cartridge by counting the number of electrical signals or hits sent to the printer pen to dispense ink. It is known that after a predetermined number of hits, no more ink will be left in the ink cartridge. The printer thus monitors how much ink is left in the ink cartridge by approximation. That is to say, the printer calculates how much ink is in the ink cartridge by the number of hits that have already been delivered to the printer pen to dispense ink from a full ink reservoir.

The conventional printer cartridge suffers from a number of drawbacks. First, the method of monitoring ink levels by approximation is imprecise and unreliable. The number of hits required to deplete each fresh batch of ink in the ink reservoir can vary. Therefore, the number of hits read by the printer may indicate that ink is still left in the ink reservoir when in fact all of the ink has been depleted. Such a lack of specificity in monitoring ink supplies can be troublesome if an operator goes into a printing job believing enough ink is left in the ink cartridge to complete the job and then the printer runs out of ink midway through the job.

A need exists for an ink monitoring system that addresses the above noted problems and others experienced heretofore.

BRIEF DESCRIPTION OF THE INVENTION

In an exemplary embodiment, an electrical connector comprises at least one body comprising a passageway for a flow of a conductive fluid. A first conductive pin is in fluid communication with the passageway, and a second conductive pin is in fluid communication with the passageway, wherein a conductive path is established through the conductive ink between the first and second conductive pins when the conductive fluid flows through the passageway.

Optionally, the first and second pins bifurcate fluid flow through the passageway, and the conductive fluid is ink. The first and second pins are adapted for connection to a sensing unit to monitor a presence of fluid in the passageway.

According to another exemplary embodiment, an ink monitoring connector assembly includes at least one body comprising a passageway for a flow of a conductive ink fluid, a first conductive pin, and a second conductive pin. The first conductive pin includes a first portion in fluid communication with the passageway and a second portion external to the body. The second conductive pin includes a first portion and in fluid communication with the passageway and a second portion external to the body, wherein an electrical circuit may be established through the conductive ink between the first portion of the first and conductive pins when the second portions of the first and second pins are coupled to a sensing unit.

According to another exemplary embodiment, an ink monitoring connector assembly comprises a body assembly comprising a plurality of passageways for a flow of a conductive ink fluid. A first conductive pin and a second conductive pin is associated with each passageway of the body assembly, and each of the first and second pins include a first portion and a second portion. The first portion is in fluid communication with the respective passageway and the second portion is external to the body. An electrical circuit may be established through the conductive ink fluid between the first portion of the conductive pins corresponding to each passageway of the body assembly when the second portions of the first and second pins are coupled to a sensing unit.

DETAILED DESCRIPTION OF THE INVENTION

Figure 19:
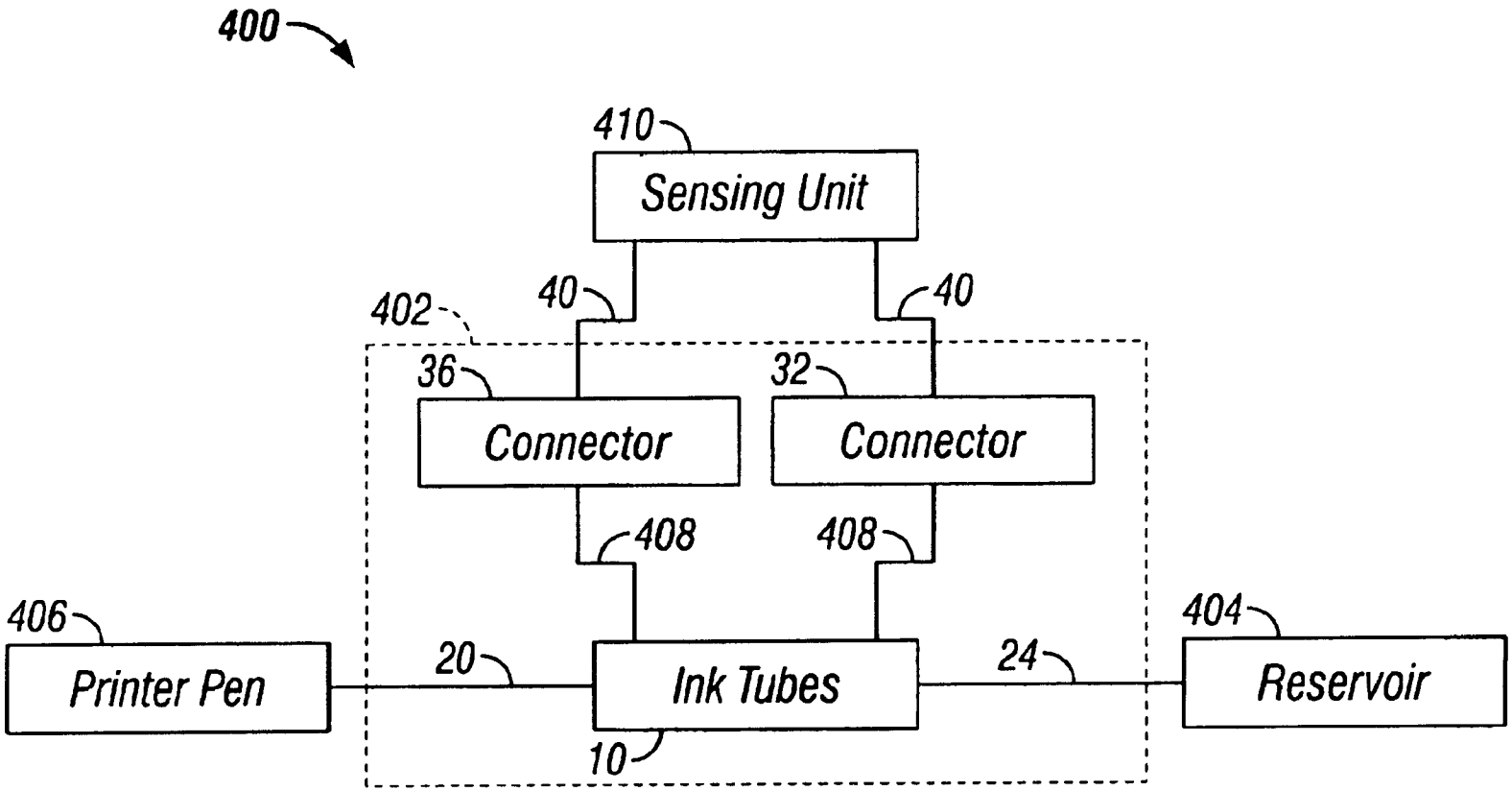
FIG. 19 is a schematic block diagram of a printer system.

FIG. 19 is a schematic view of a printer system 400 in which embodiments of an ink monitoring assembly 402 formed in accordance with the present invention may be employed. The system 400 includes an ink reservoir 404 adapted to hold a quantity of conductive printer ink. In use, ink is directed from the reservoir 404 through one of a plurality of conduits 24 to one or more ink tubes 10, depending on the color and/or quantity of selected ink, and from the ink tubes 10 through pen conduits 20 to a printer pen 406 where the ink is applied to paper.

Conductive pins 408, various embodiments of which are described below, are coupled to the ink tubes 10 in fluid communication with the conductive ink therein to complete a conductive path through the pins and the ink therebetween, and hence completing an electrical circuit through each of the tubes 10 through the respective pins 408. The pins 408 are coupled to connectors 32 and 26, which in turn are coupled to sensing unit 410, and the sensing unit 410 senses the presence or absence of a completed electrical circuit through the pins 408. Such sensing may be accomplished with known circuitry and devices which monitor voltage, current, or other indicia of interest to determine whether a circuit is completed. When the electrical circuit is broken, the sensing unit 410 may signal a user interface (not shown) or a peripheral device such as a PC (not shown) that the reservoir is out of ink.

While the invention is described in the context of printer system 400, it is appreciated that the benefits of the invention may accrue to other applications of fluid monitoring devices, and the invention is therefore not intended to be limited solely to a component of a printer system. The embodiments described an illustrated herein are therefore set forth for illustrative purposes only and are not intended to limit the invention to the particular embodiments and applications described.

Figure 1:
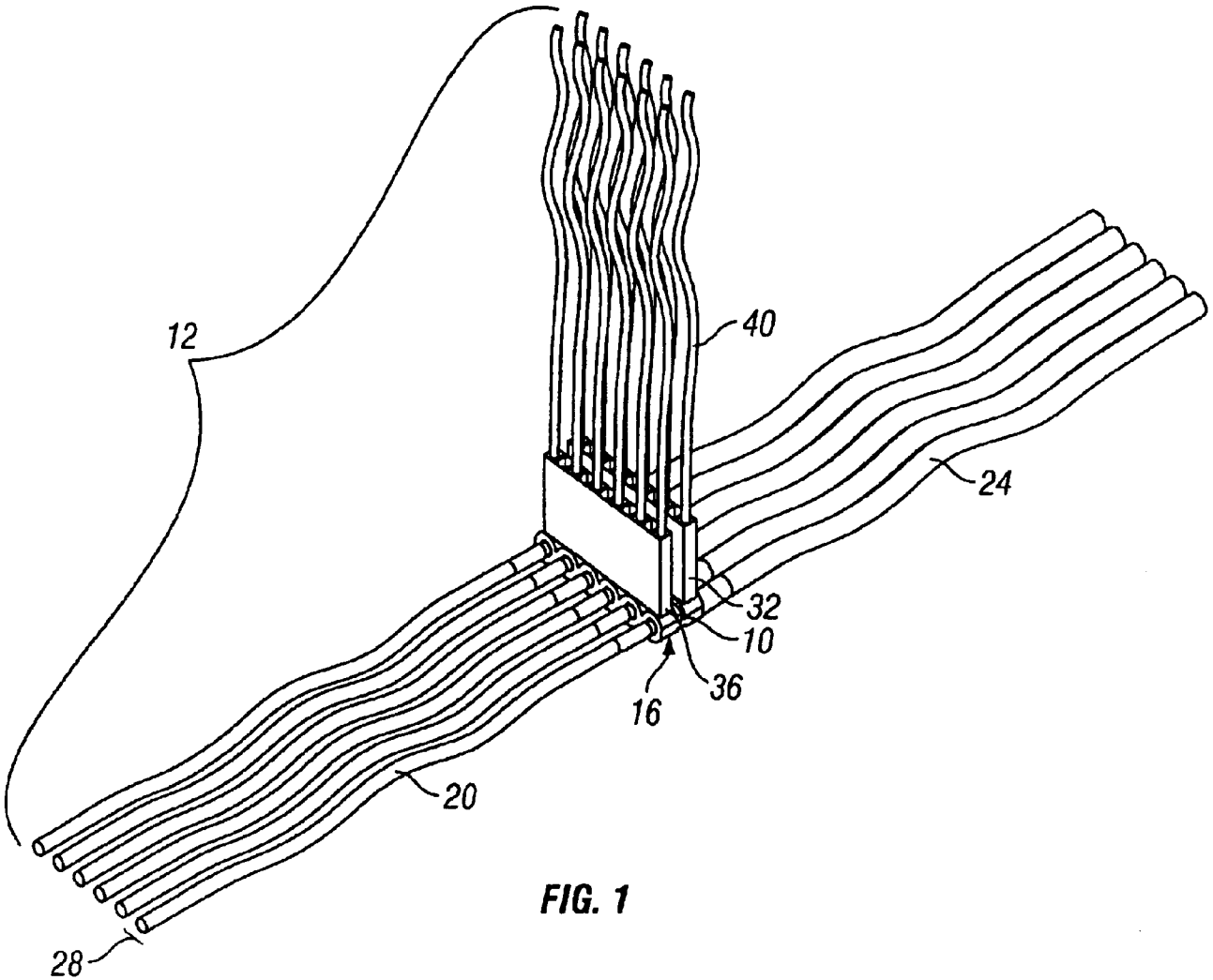
FIG. 1 illustrates an isometric view of an ink monitoring connector assembly.

Referring now to FIG. 1, an exemplary embodiment of an ink monitoring connector assembly 12 is illustrated. The assembly 12 includes a ganged housing 16 of parallel ink tubes 10 formed with each other. Each ink tube 10 frictionally engages and seals a pen conduit 20 on one side and a reservoir conduit 24 on the other side to form an ink line 28. The pen conduits 20 are cylindrical tubes that are connected to a printer pen (not shown). The printer pen dispenses certain amounts and colors of ink on paper. The reservoir conduits 24 are cylindrical tubes that are connected to an ink reservoir (not shown). The ink reservoir supplies printer ink to the printer pen via an ink line 28. Each ink line 28 may carry a different color of ink. The ganged housing 16 is also connected to parallel first and second connectors 32 and 36. The first and second connectors 32 and 36 are connected by signal lines 40 to a sensing unit, such as unit 410 shown in FIG. 19, which monitors the flow of printer ink through each ink tube 10.

Figure 2:
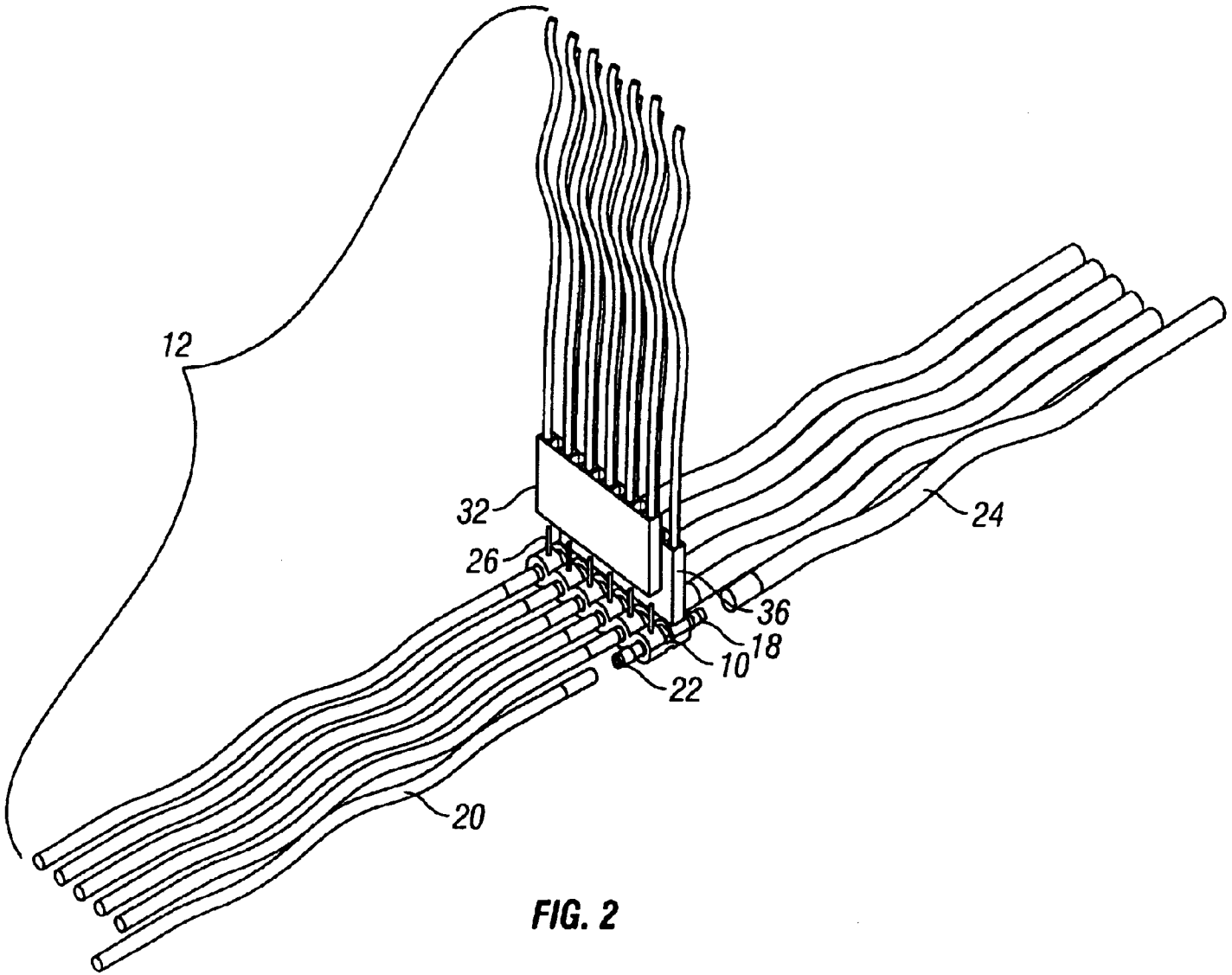
FIG. 2 illustrates a partially exploded isometric view of the ink monitoring connector assembly of FIG. 1.

FIG. 2 illustrates a partially exploded isometric view of the ink monitoring connector assembly 12 of FIG. 1. Each ink tube 10 has an entry pipe 18 that is connected to a reservoir conduit 24 and an exit pipe 22 connected to a pen conduit 20. Each ink tube 10 also has cylindrical conductive pins 26 that are received in the first and second connectors 32 and 36 and connected to the sensing unit 410 (FIG. 19).

Figure 14:
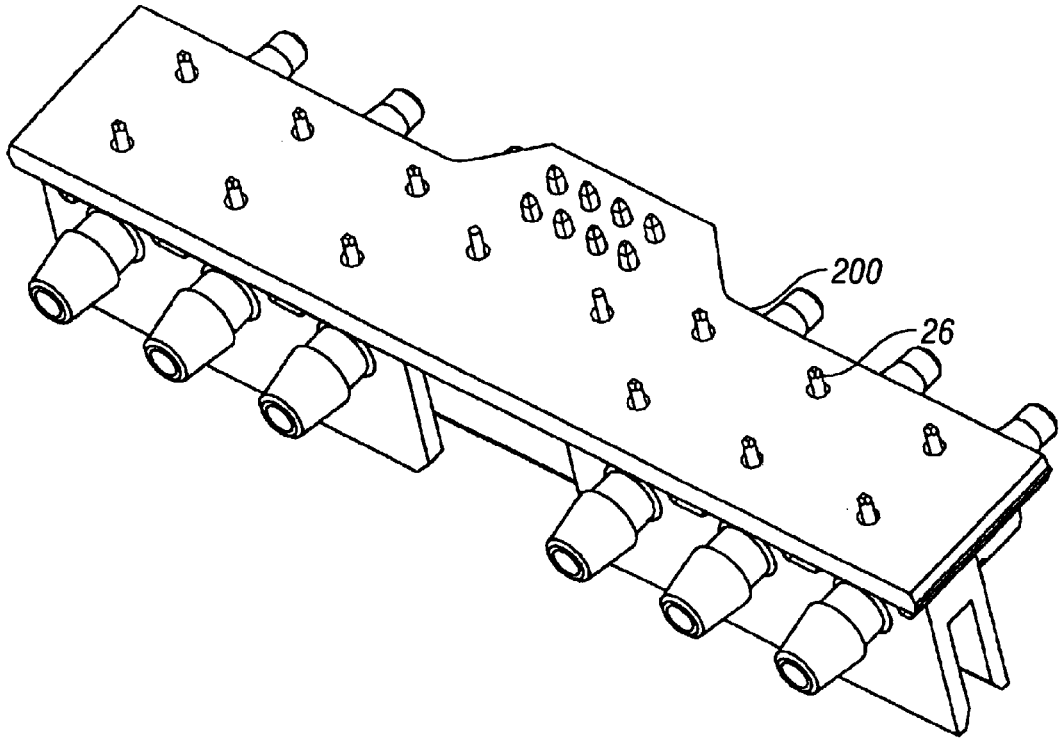
FIG. 14 illustrates an isometric view of a ganged housing connected to a printed circuit board.

Alternatively, as shown in FIG. 14, the pins 26 may be fitted into a printed circuit board 200. The printed circuit board 200 is then connected to the sensing unit 410 (FIG. 19).

Figure 3:
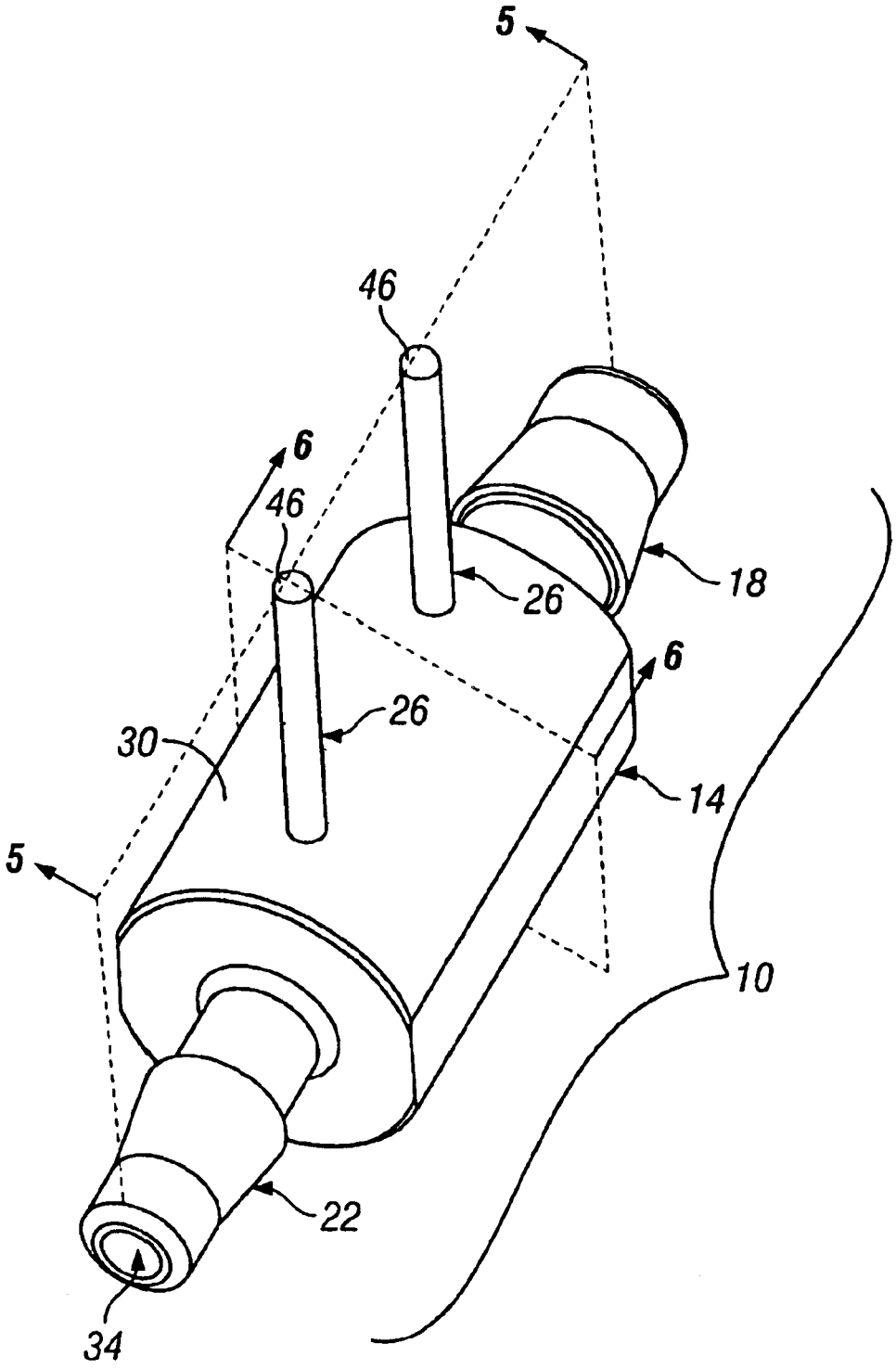
FIG. 3 illustrates an isometric view of an ink tube formed according to an embodiment of the present invention.

FIG. 3 illustrates an isometric view of an ink tube 10 formed according to an embodiment of the present invention. The ink tube 10 has a non-conductive cylindrical body 14 that includes the entry pipe 18 and the exit pipe 22 on opposite ends thereof. A passageway 34 extends through the entry pipe 18, the exit pipe 22, and the body 14. The entry pipe 18 is connected to the ink reservoir (not shown) by the reservoir conduit 24 (FIG. 1) and the exit pipe 22 is connected to the printer pen (not shown) by the pen conduit 20 (FIG. 1). Conductive printer ink flows from the reservoir through the passageway 34 of the ink tube 10 to the printer pen. The pins 26 extend through a top wall 30 of the body 14 into the passageway 34 within the body 14 and are positioned in the path of the flow of printer ink. The pins 26 have contact ends 46 that are connected to the first and second connectors 32 and 36 (FIG. 1) and thus to the sensing unit 410 (FIG. 19). The pins 26 are formed of a conductive, non-corrosive material such as stainless steel.

Figure 4:
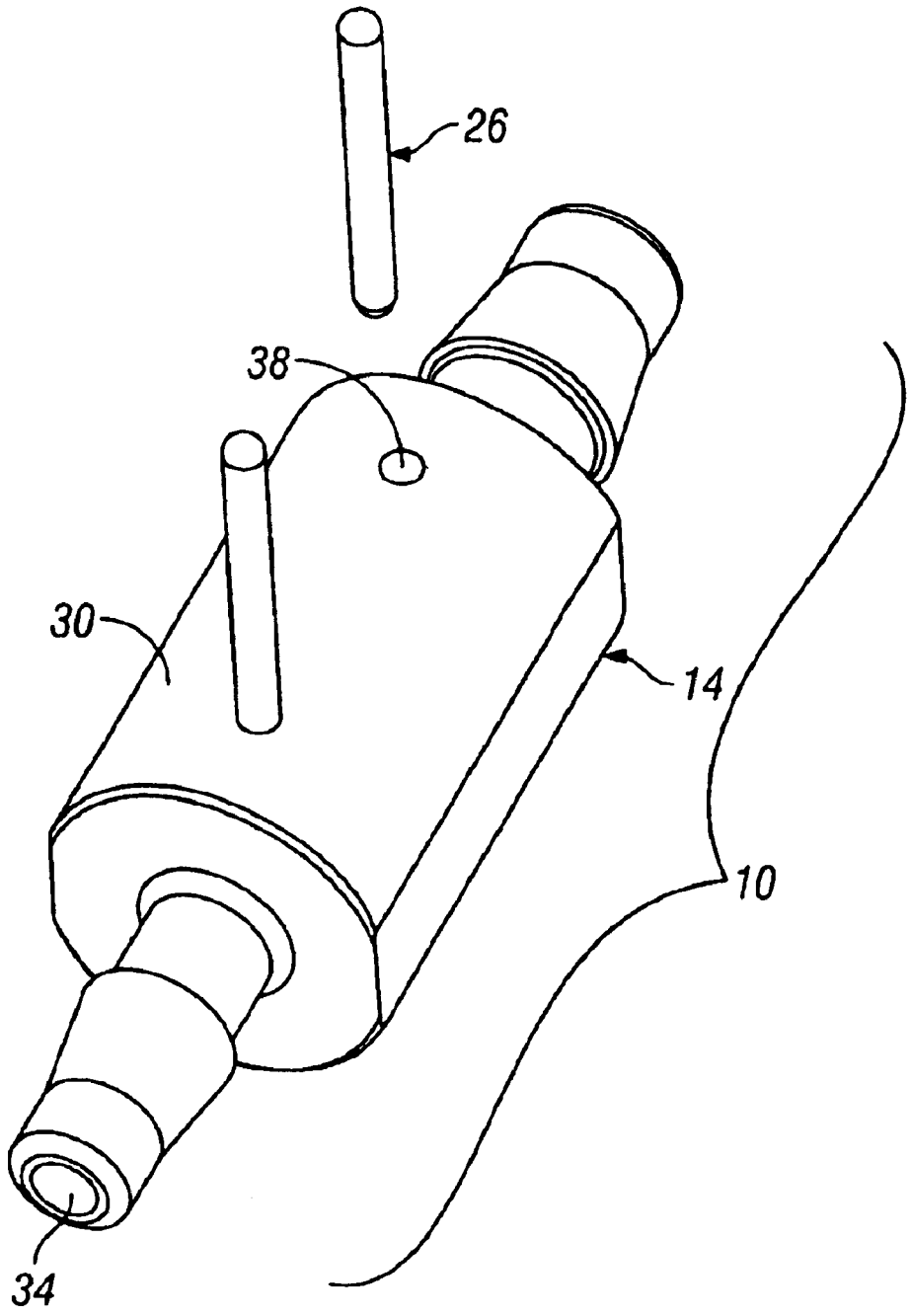
FIG. 4 illustrates an isometric view of the ink tube of FIG. 3 with a pin removed.

FIG. 4 illustrates an isometric view of the ink tube 10 of FIG. 3 with a pin 26 removed. As shown, circular apertures 38 extend through the top wall 30 of the body 14 of the ink tube 10 into the passageway 34. The apertures 38 receive the pins 26 and retain the pins 26 in the body 14. The pins 26 form a non-leaking seal within the apertures 38.

Figure 5:
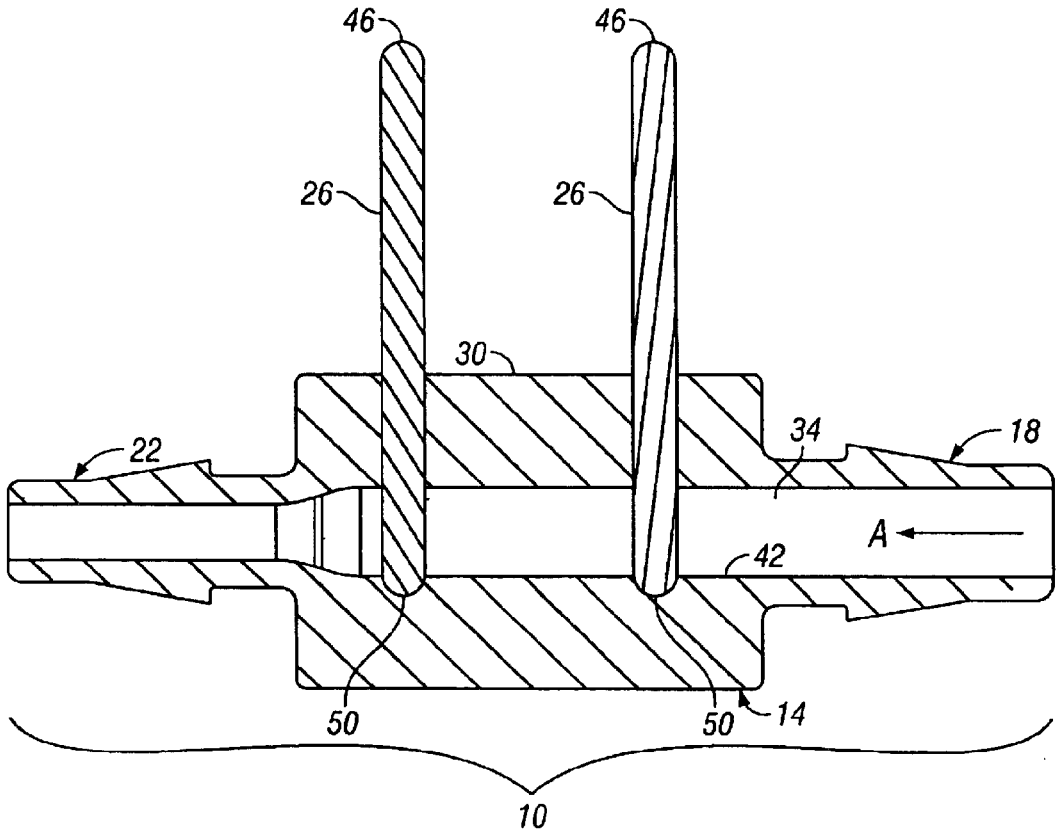
FIG. 5 illustrates a side cross sectional view of the ink tube of FIG. 3 taken along section 5—5 of FIG. 3.

FIG. 5 illustrates a side cross sectional view of the ink tube 10 of FIG. 3 taken along section 5—5 of FIG. 3. The passageway 34 extends linearly through the body 14 and the entry and exit pipes 18 and 22. The pins 26 extend through the top wall 30 of the body 14 and the passageway 34 and have retention ends 50 that are anchored in a bottom wall 42 of the body 14. Printer ink flows through the passageway 34 in the direction of arrow A around the pins 26. The top and bottom walls 30 and 42 of the body 14 form tight seals with the pins 26 along the passageway 34 in order to prevent leaking and reduce interruptions in the flow of printer ink.

Figure 6:
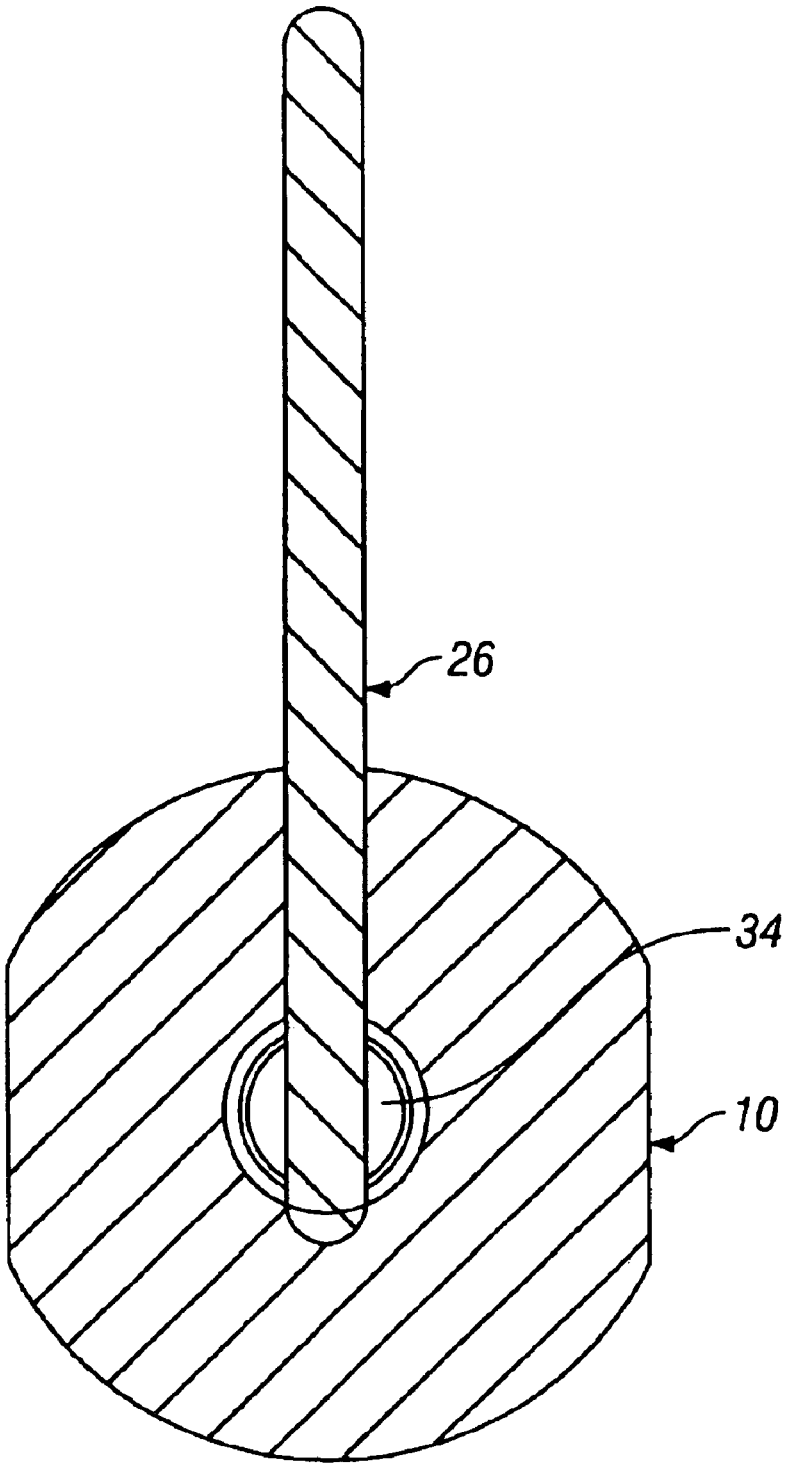
FIG. 6 illustrates a front cross sectional view of the ink tube of FIG. 3 taken along section 6—6 of FIG. 3.

FIG. 6 illustrates a front cross sectional view of the ink tube 10 of FIG. 3 taken along section 6—6 of FIG. 3. The pins 26 are positioned in the center of the passageway 34 and bifurcate the flow of printer ink along the sides of the pins 26. Thus, as the printer ink flows through the passageway 34, the printer ink contacts the pins 26.

Returning to FIG. 5, in operation, the conductive printer ink flows through the ink tube 10 from the ink reservoir to the printer pen in the direction of arrow A. An electrical signal is introduced to the upstream pin 26 at the exposed end 46 by the sensing unit 410 (FIG. 19) via the first connector 32 (FIG. 1). The signal travels across the pin 26 into contact with the flowing printer ink in the passageway 34. The printer ink serves as a conductive conduit that carries the electrical signal to the downstream pin 26 which in turn processes the electrical signal through its exposed end 46 to the sensing unit 410 (FIG. 19) via the second connector 36 (FIG. 1). The printer ink and the pins 26 thus form an electrical circuit that is monitored by the sensing unit 410 (FIG. 19). When the ink reservoir runs out of printer ink and printer ink ceases to flow through the passageway 34, the electrical circuit is broken and the sensing unit 410 (FIG. 19) notifies the operator that the printer pen is no longer receiving ink from the ink reservoir. Thus, the operator knows that only the printer ink left in the printer pen is available for printing until the ink reservoir is refilled.

Figure 7:
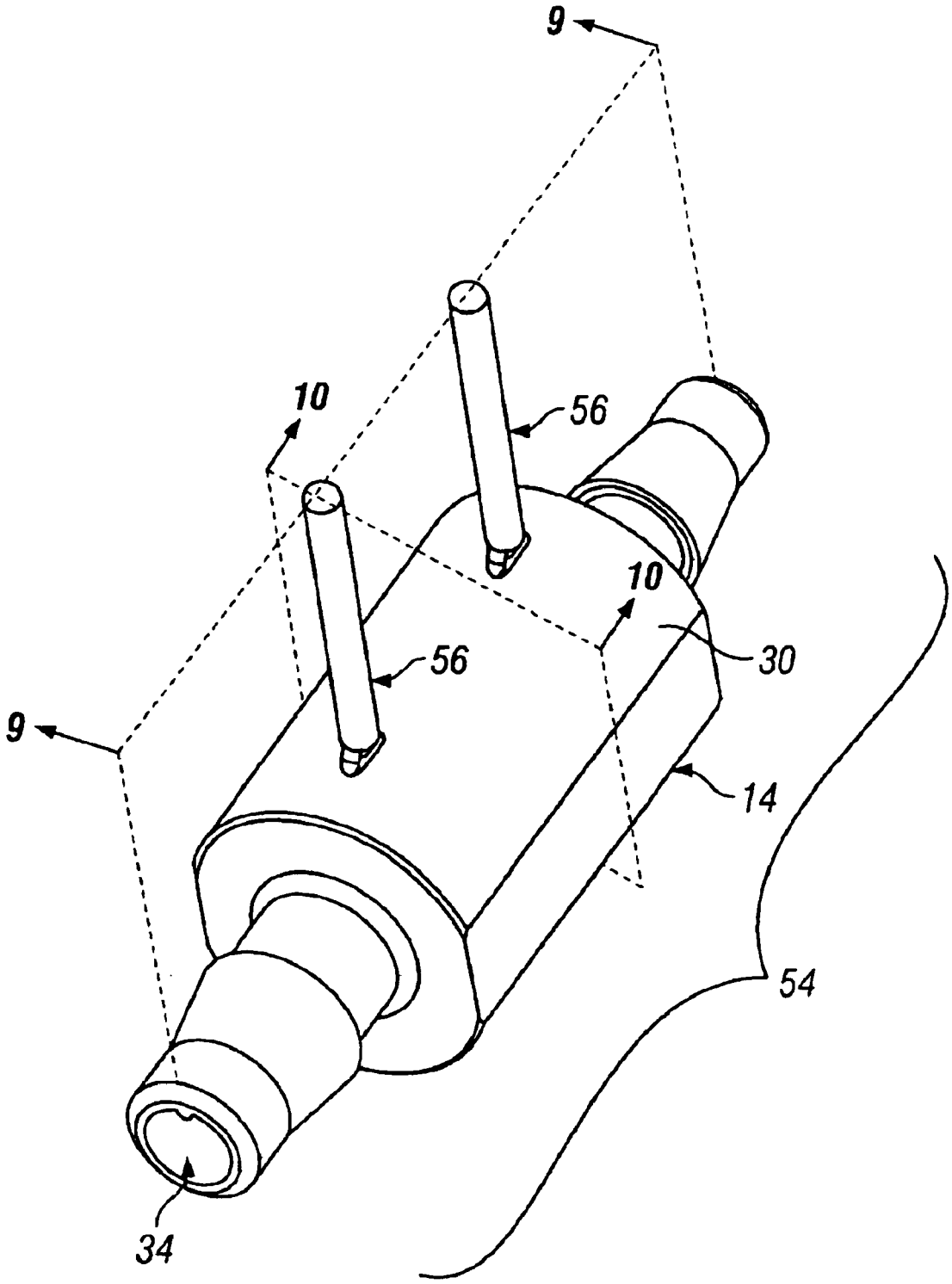
FIG. 7 illustrates an isometric view of an ink tube formed according to an embodiment of the present invention.

FIG. 7 illustrates an isometric view of an ink tube 54 formed according to an embodiment of the present invention. The ink tube 54 is generally similar to the ink tube 10 of FIGS. 1–6, however, the ink tube 54 carries paddle-shaped pins 56 that extend through the top wall 30 of the body 14 into the passageway 34.

Figure 8:
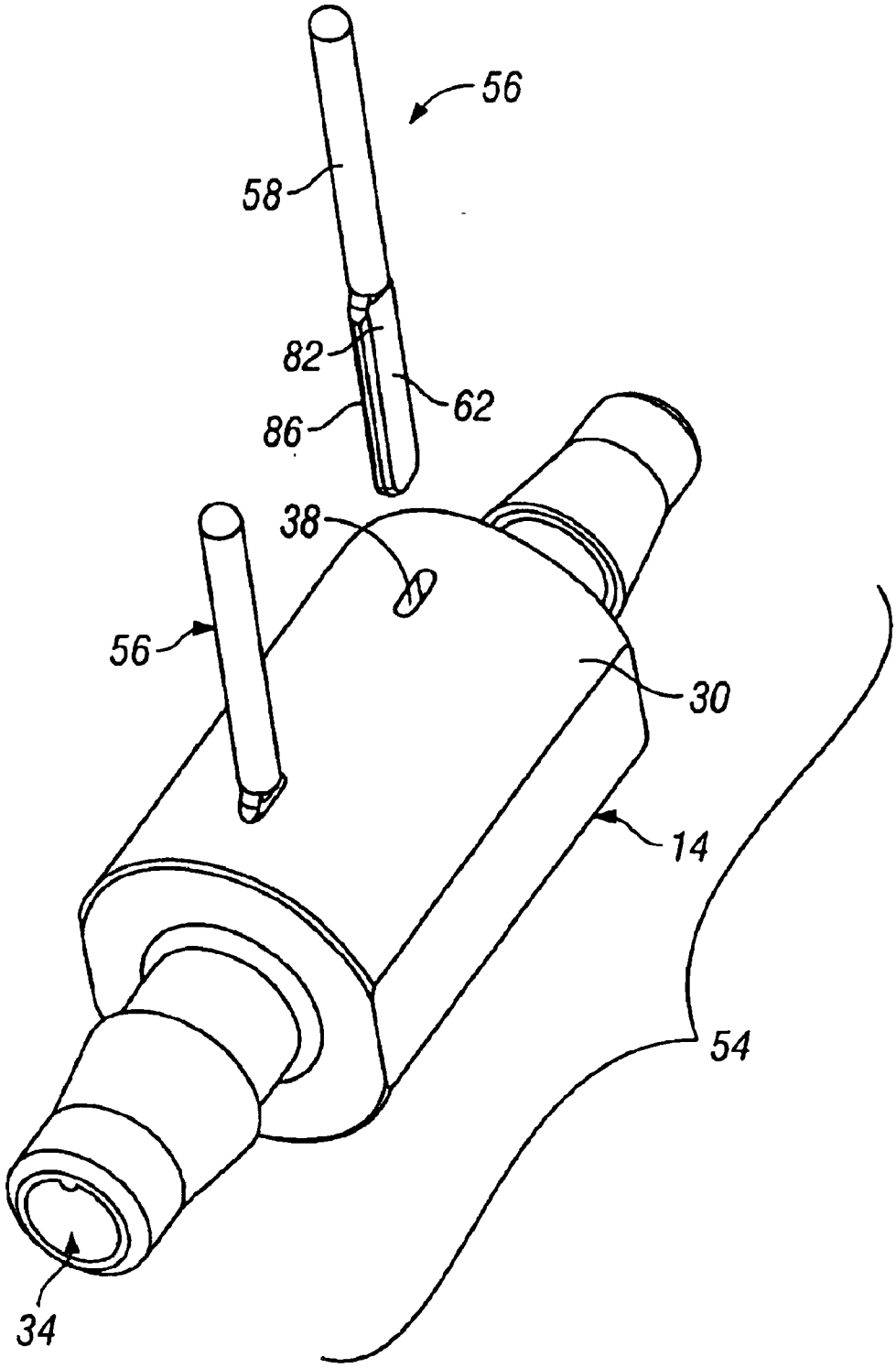
FIG. 8 illustrates an isometric view of the ink tube of FIG. 7 with a pin removed.

FIG. 8 illustrates an isometric view of the ink tube 54 of FIG. 7 with a pin 56 removed. The pin 56 has a cylindrical top portion 58 formed with a planar, paddle-shaped bottom portion 62. The bottom portion 62 has generally rectangular sidewalls 82 formed with rounded edges 86. The bottom portion 62 is wider than the top portion 58 across the sidewalls 82 and thinner than the top portion 58 across the edges 86. As shown, oval apertures 38 extend through the top wall 30 of the body 14 of the ink tube 54 into the passageway 34. The apertures 38 receive the bottom portions 62 of the pins 56 and retain the pins 56 in the body 14.

Figure 9:
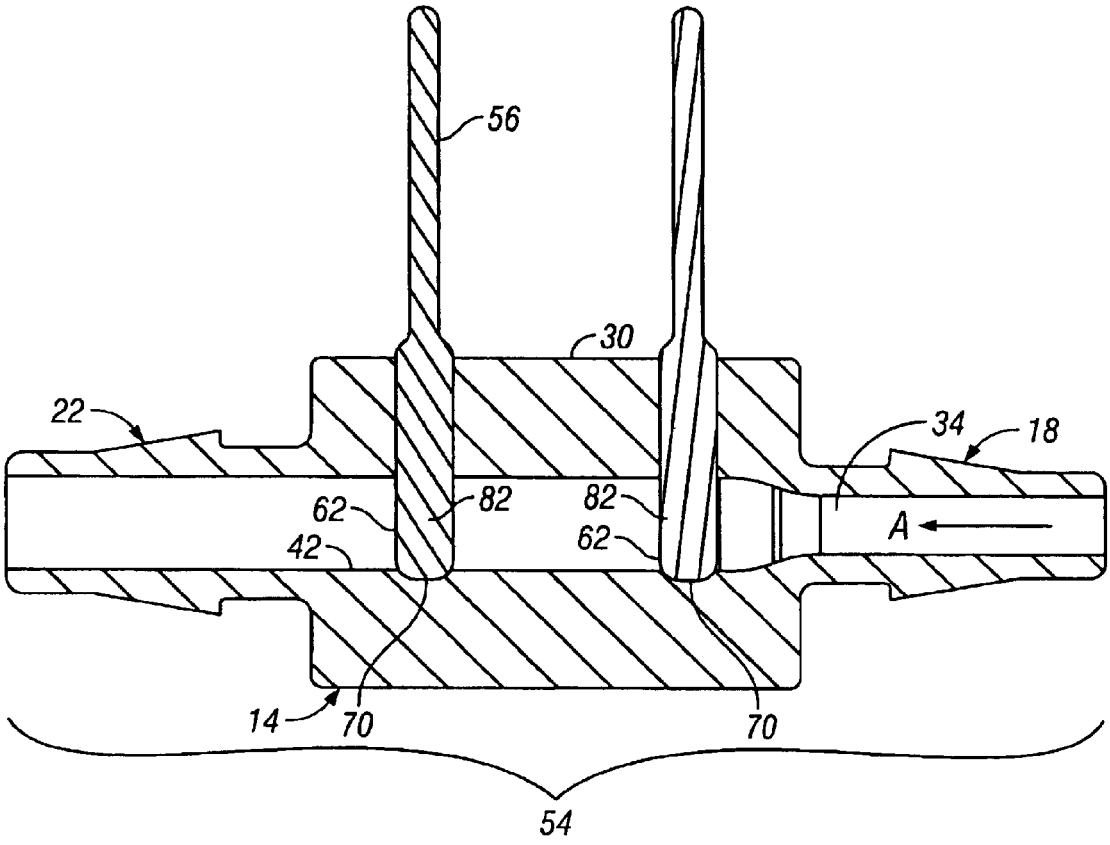
FIG. 9 illustrates a side cross sectional view of the ink tube of FIG. 7 taken along section 9—9 of FIG. 7.

FIG. 9 illustrates a side cross sectional view of the ink tube 54 of FIG. 7 taken along section 9—9 of FIG. 7. The passageway 34 extends linearly through the body 14 and the entry and exit pipes 18 and 22. The pins 56 extend through the top wall 30 of the body 14 and the passageway 34 and have retention ends 70 that are anchored in the bottom wall 42 of the body 14. Printer ink flows through the passageway 34 in the direction of arrow A around the bottom portions 62 of the pins 56. The bottom portions 62 of the pins 56 are oriented in the passageway 34 such that the side walls 82 are parallel with the direction of the printer ink flow. In other words, the bottom portions 62 of the pins 56 are positioned to minimally obstruct the flow of the printer ink in the passageway 34. The top and bottom walls 30 and 42 of the body 14 form tight seals with the bottom portions 62 of the pins 56 along the passageway 34 in order to prevent leaking and reduce interruptions in the flow of printer ink.

Figure 10:
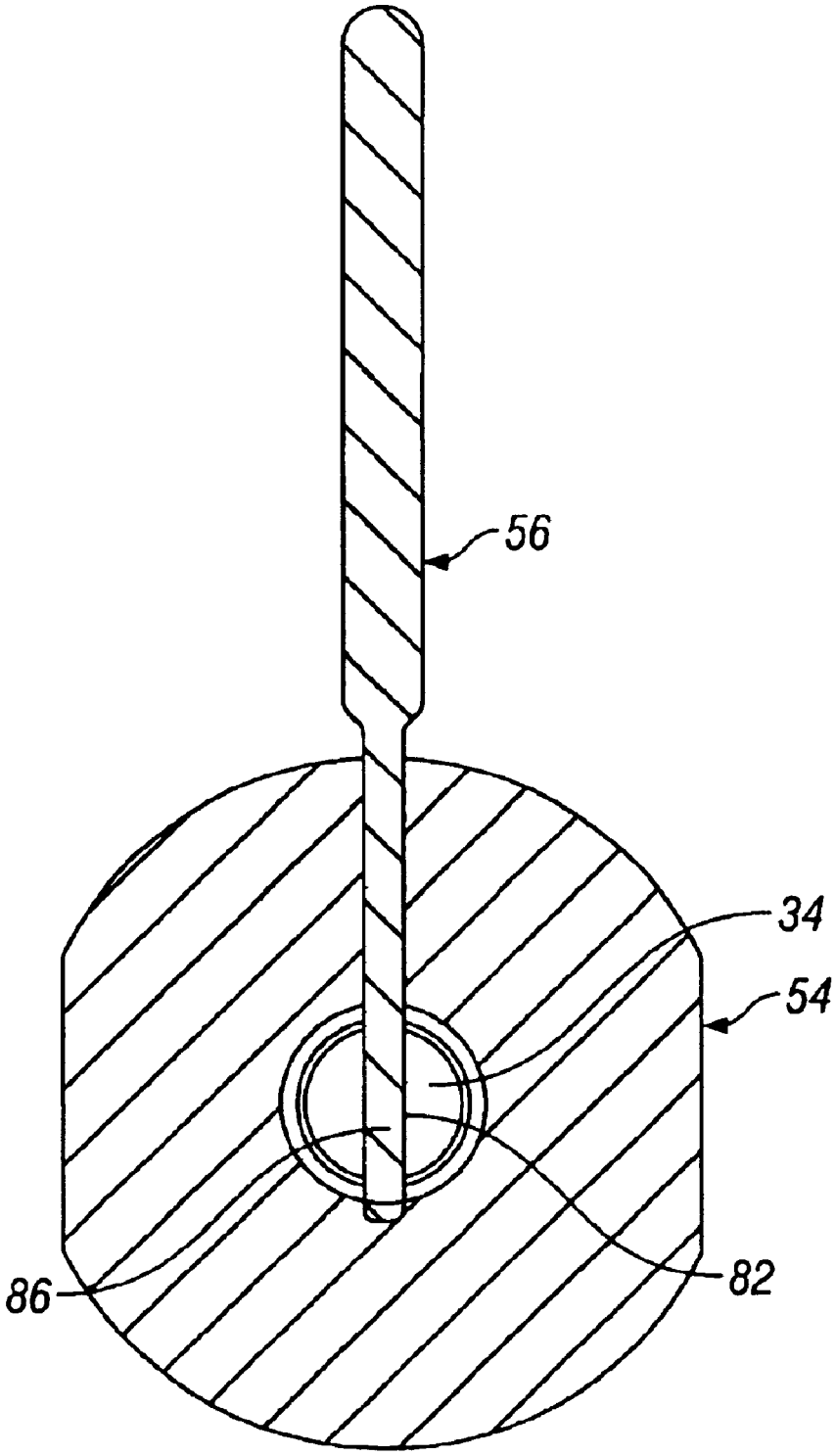
FIG. 10 illustrates a front cross sectional view of the ink tube of FIG. 7 taken along section 10—10 of FIG. 7.

FIG. 10 illustrates a front cross sectional view of the ink tube 54 of FIG. 7 taken along section 10—10 of FIG. 7. The pins 56 are positioned in the center of the passageway 34 such that the rounded edges 86 bifurcate the flow of printer ink along the side walls 82 of the pins 56. Thus, as the printer ink flows through the passageway 34, the printer ink contacts the pins 56 along the extended surface area of the side walls 82. The pins 56 operate similarly to the pins 26 of the embodiment of FIGS. 1–6 to form an electrical circuit with the flowing printer ink. The embodiment of FIGS. 7–10 reduces interference with the flow of the printer ink while increasing the surface area of the pins 56 contacting the printer ink. By reducing interference with the flow of the printer ink, the printer ink flows through the passageway 34 at a faster speed. By increasing the surface area of the contact between the pins 56 and the printer ink, a better electrical connection is formed between the two pins 56. For example, if an air bubble forms in the passageway 34 around a pin 56, the printer ink is still likely to contact the pin 56 and maintain the circuit because of the increased surface area of the pin 56. Thus, the pins 56 reduce the chances of the sensing unit 410 (FIG. 19) registering a false positive when an air bubble surrounds a pin 56.

Figure 11:
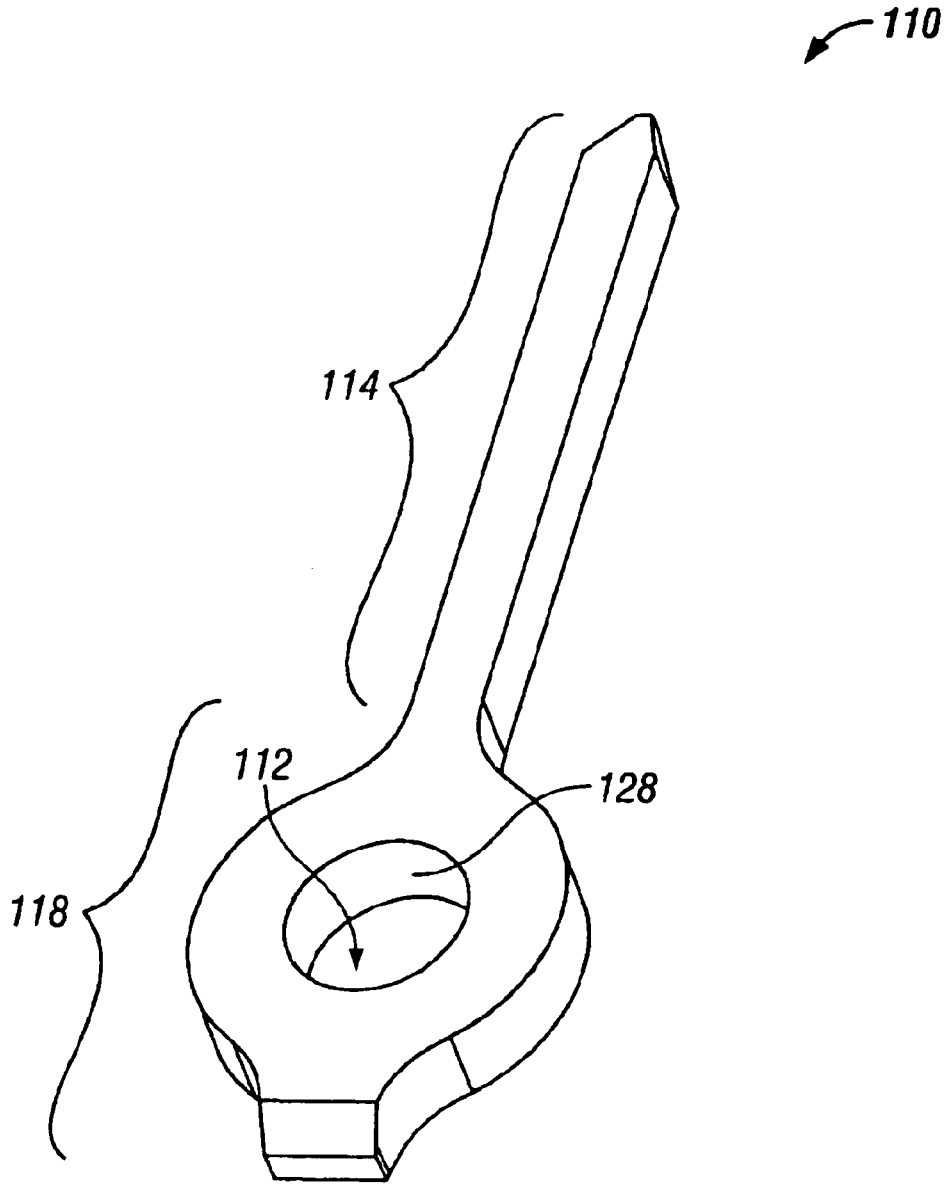
FIG. 11 illustrates an isometric view of a pin formed according to an embodiment of the present invention.
Figure 12:
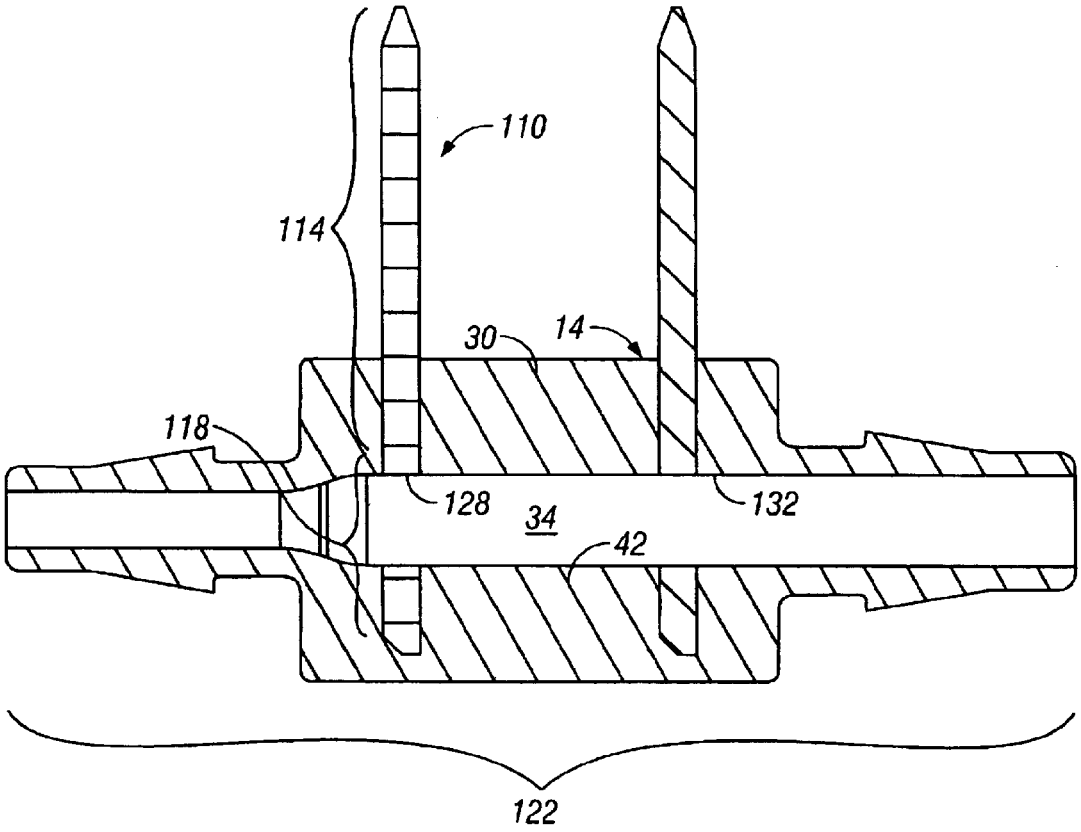
FIG. 12 illustrates a side cross sectional view of an ink tube formed according to an embodiment of the present invention.

FIG. 11 illustrates an isometric view of a pin 110 formed according to an embodiment of the present invention. The pin 110 has a square upper portion 114 formed with a ring-shaped lower portion 118. The lower portion 118 has an inner wall 128 that defines a circular passageway 112 with a diameter that is generally similar to the diameter of the passageway 34 of an ink tube 122 (FIG. 12). The pin 110 operates similarly to the pins 26 and 56 of the above embodiments. The upper portion 114 engages the first and second connectors 32 and 36 (FIG. 1) and the lower portion 118 engages the flowing printer ink.

FIG. 12 illustrates a side cross sectional view of an ink tube 122 formed according to an embodiment of the present invention. The upper portions 114 of the pins 110 are insert molded within the top wall 30 of the body 14 and the lower portions 118 are insert molded within the body 14 along the passageway 34. The lower portion 118 of each pin 110 is sealed tightly within the top and bottom walls 30 and 42 of the body 14 such that the inner wall 128 of the lower portion 118 is generally flush with an inner wall 132 of the passageway 34. Thus, the printer ink flows through the passageway 34 with limited interruption and engages the inner walls 128 of the pins 110 to form an electrical circuit.

Figure 13:
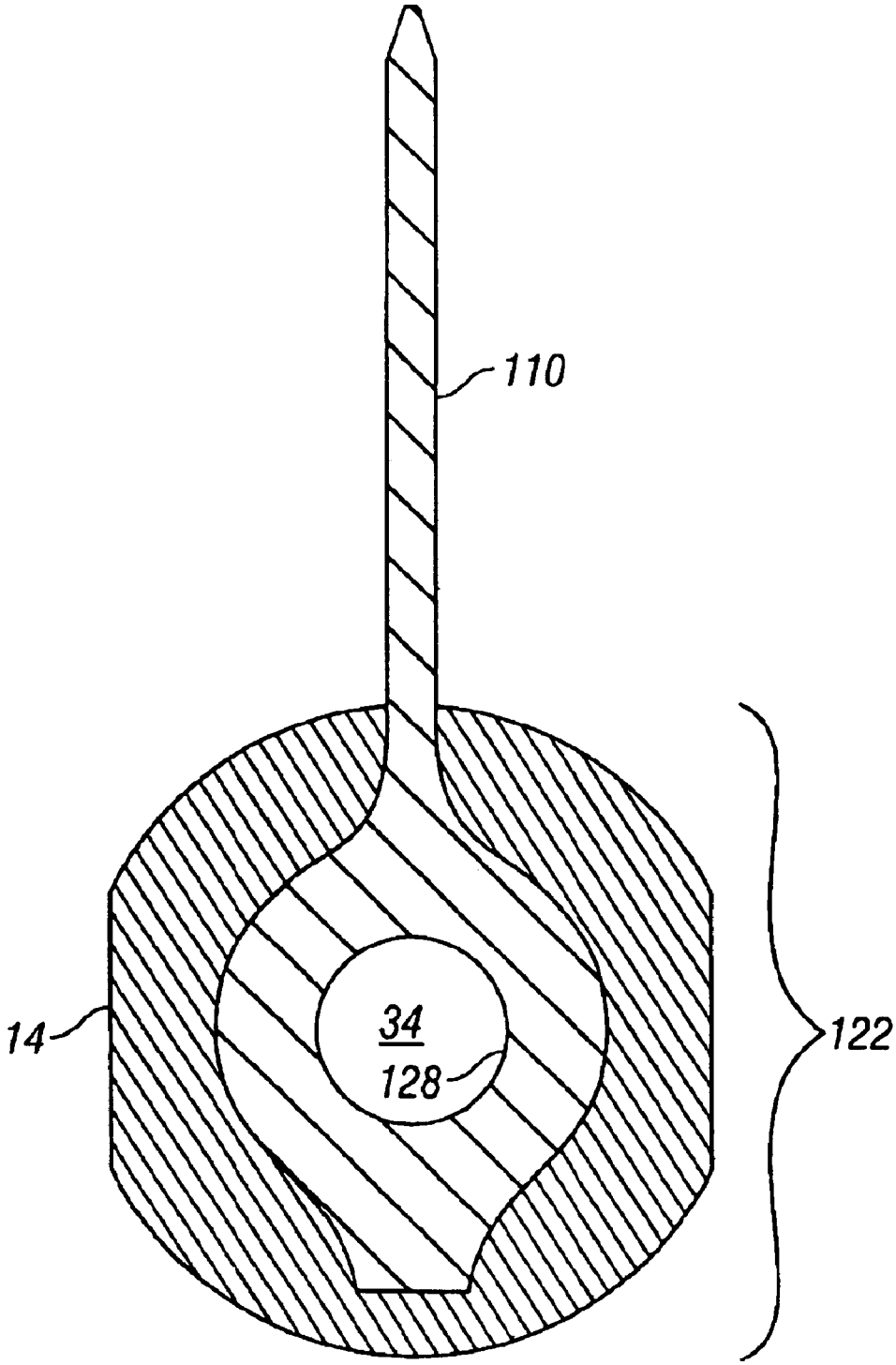
FIG. 13 illustrates a front cross sectional view of an ink tube formed according to an embodiment of the present invention.

FIG. 13 illustrates a front cross sectional view of the ink tube 122 formed according to an embodiment of the present invention. The pins 110 are positioned within the body 14 and around the passageway 34 such that the printer ink flows through the passageway 34 and pins 110 generally unimpeded. The printer ink contacts the inner walls 128 of the pins 110 as it flows through the passageway 34. The inner walls 128 provide surface area around the entire diameter of the passageway 34 for the printer ink to contact. The pins 110 operate similarly to the pins 26 and 56 of the above embodiments of FIGS. 1–10 to form an electrical circuit with the flowing printer ink. The embodiment of FIGS. 11–13 greatly reduces interference with the flow of the printer ink while increasing the surface area of the pins 110 contacting the printer ink. By reducing interference with the flow of the printer ink, the printer ink flows through the passageway 34 at a faster speed. By increasing the surface area of the contact between the pins 110 and the printer ink, a better electrical connection is formed between the two pins 110. For example, if an air bubble forms in the passageway 34 along a pin 110, the printer ink is still likely to contact the pin 110 and maintain the circuit because of the increased surface area of the pin 110. Thus, the pins 110 reduce the chances of the sensing unit 410 (FIG. 19) registering a false positive when an air bubble surrounds one of the pins 110.

Figure 15:
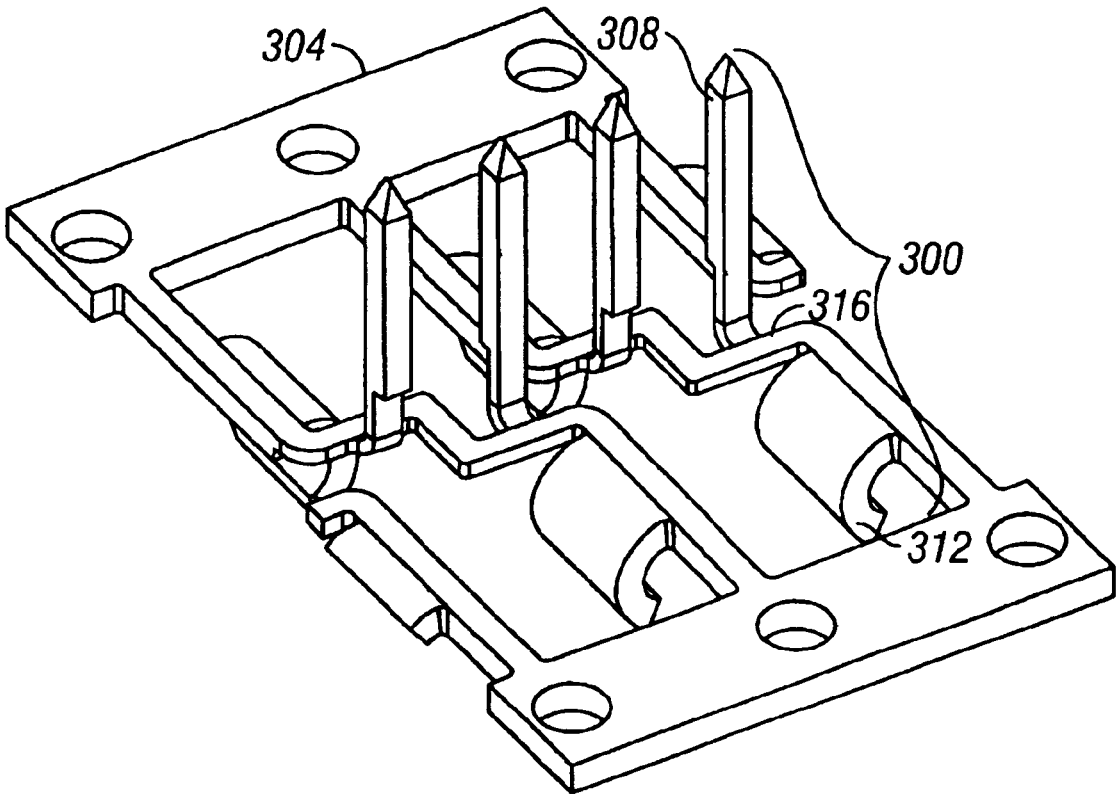
FIG. 15 illustrates an isometric view of lead frame pins formed according to an embodiment of the present invention.

FIG. 15 illustrates an isometric view of lead frame pins 300 formed according to an embodiment of the present invention. The pins 300 are shown formed with a carrier strip 304. The pins 300 have a rectangular shaped top portion 308 connected to a semi-cylindrical bottom portion 312 by a thin strip 316. The pin 300 operates similarly to the pins 26, 56, and 110 of the above embodiments. The top portion 308 engages a connector (not shown) and the bottom portion 312 engages the flowing printer ink.

Figure 16:
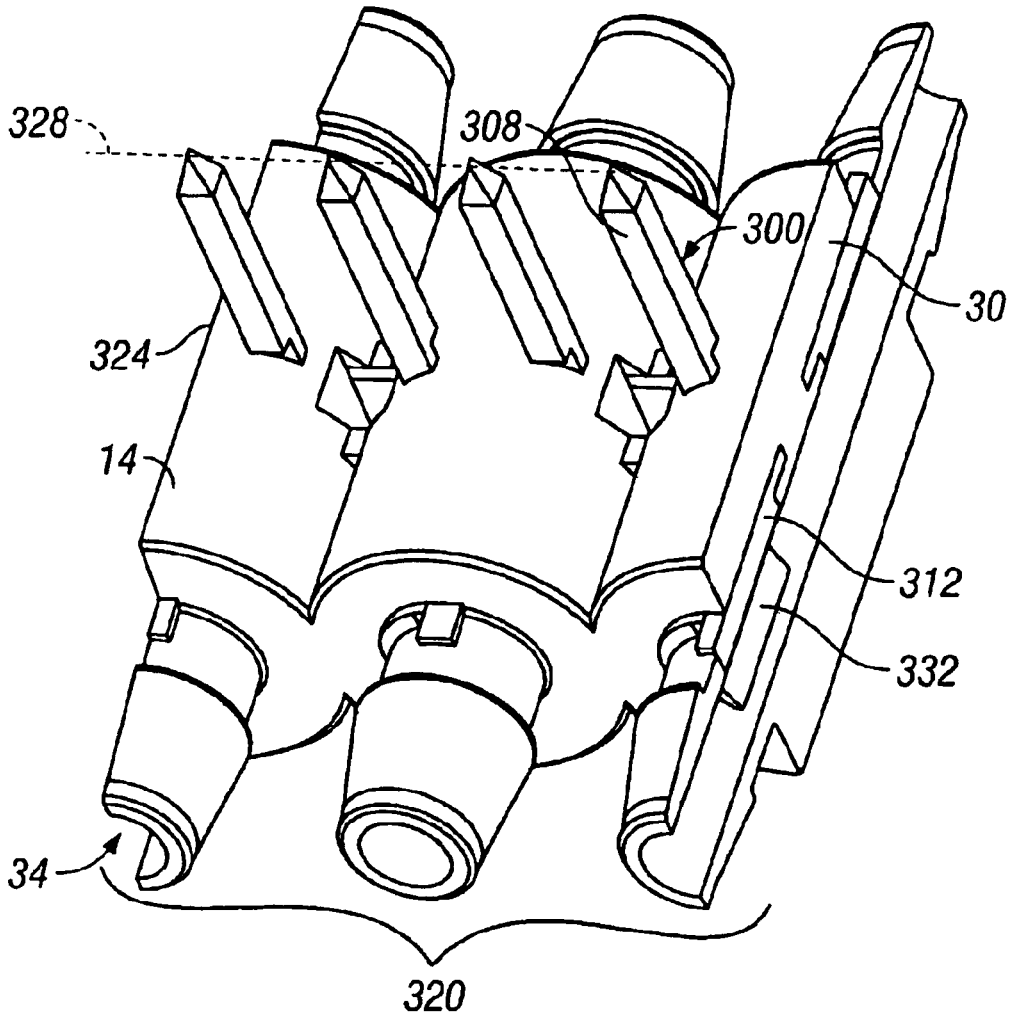
FIG. 16 illustrates a partial isometric view of a ganged housing of ink tubes formed according to an embodiment of the present invention.

FIG. 16 illustrates a partial isometric view of a ganged housing 320 of ink tubes 324 formed according to an embodiment of the present invention. During assembly, the pins 300 are over-molded within the bodies 14 of the ink tubes 324 about the passageways 34. The carrier strip 304 (FIG. 15) is then detached from the pins 300. The bottom portion 312 of each pin 300 is sealed tightly within the body 14 about the passageway 34 and has a foot 332 that extends slightly into the passageway 34. The top portions 308 of the pins 300 extend through apertures in the top walls 30 of the ink tubes 324 and are aligned along a common centerline 328. The, pins 300 thus can all be connected with a single connector or a printed circuit board. The printer ink flows through the passageway 34 and engages the feet 332 of the pins 300 to form an electrical circuit.

Figure 17:
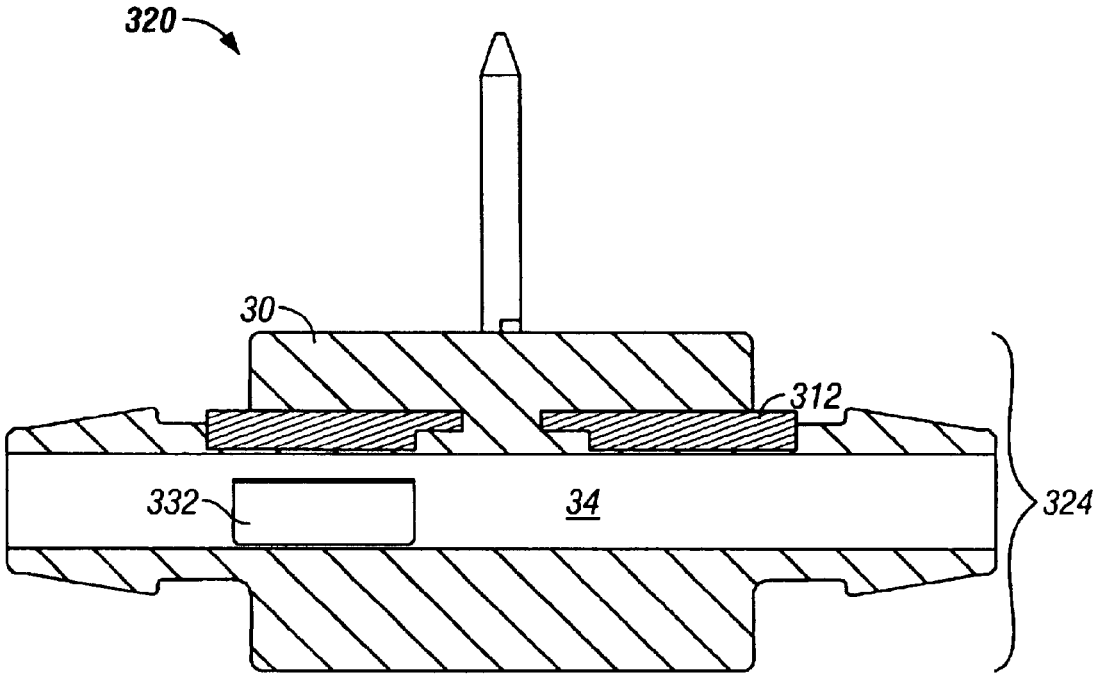
FIG. 17 illustrates a side view of the ganged housing of ink tubes of FIG. 16.

FIG. 17 illustrates a side view of the ganged housing 320 of ink tubes 324 of FIG. 16. Each bottom portion 312 is formed within the top wall 30 of an ink tube 324 such that the foot 332 extends into the passageway 34 within the flow path of the printer ink. The foot 332 has a large surface area that engages the printer ink.

Figure 18:
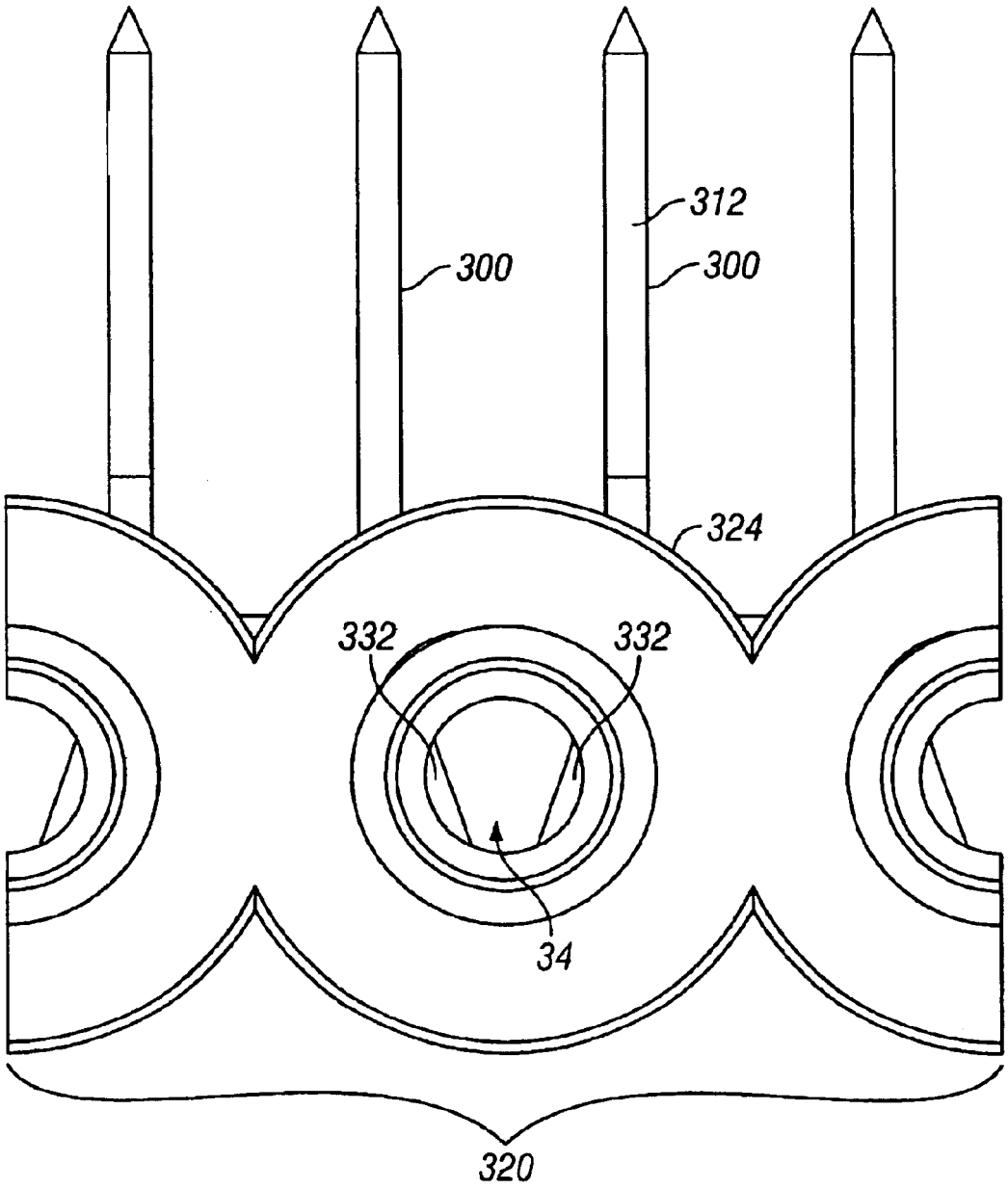
FIG. 18 illustrates a front view of the ganged housing of ink tubes of FIG. 16.

FIG. 18 illustrates a front view of the ganged housing 320 of ink tubes 324 of FIG. 16. The feet 332 are positioned within the passageway 34 such that the printer ink flows through the passageway 34 generally unimpeded. The printer ink contacts the feet 332 as it flows the passageway 34 and forms an electrical circuit between the pins 300 formed within an ink tube 324. The embodiment of FIGS. 15–18 reduces interference with the flow of the printer ink while increasing the surface area of the pins 300 contacting the printer ink. By increasing the surface area of the contact between the pins 300 and the printer ink, a better electrical connection is formed between the two pins 300. Additionally, by aligning all the top portions 308 of the pins 300 in a common centerline 328 (FIG. 16), fewer electrical connectors are needed to connect the pins 300 to the sensing unit 410 (FIG. 19) and thus the ink monitoring connector assembly takes up less space. Additionally, by employing a fewer number of electrical connectors in the ink monitoring connector assembly, cost savings may be realized.

While the invention has been described in terms of various specific embodiments, those skilled in the art will recognize that the invention can be practiced with modification within the spirit and scope of the claims.

What is claimed is:

1. An electrical connector comprising:

at least one body comprising a passageway for a flow of a conductive fluid;

a first conductive pin in fluid communication with said passageway; and a second conductive pin in fluid communication with said passageway, wherein when an electrical signal is introduced is introduced to said first pin, said conductive fluid serves as a conductive conduit between said first and second conductive pins when said conductive fluid flows through said passageway, whereby said electrical signal is carried to said second pin via said conductive fluid to detect a presence of the conductive fluid in said passageway.

2. An electrical connector in accordance with claim 1 wherein at least one of said first and second conductive pins includes first and second parallel sides, said parallel sides oriented parallel to a direction of fluid flow of said conductive fluid.

3. An electrical connector in accordance with claim 1 wherein at least one of said pins comprises a passageway therethrough for passage of said conductive fluid.

4. An electrical connector in accordance with claim 1 wherein at least one of said first and second pins bifurcates fluid flow through said passageway.

5. An electrical connector in accordance with claim 1 wherein a portion of one of said first and second pins is semi-cylindrical.

6. An electrical connector in accordance with claim 1 further comprising a second body ganged to said first body, said second body comprising a passageway therethrough for transmission of conductive fluid, and a third and fourth conductive pin in fluid communication with said passageway of said second housing for establishing a conductive path through conductive fluid in said second body.

7. An electrical connector in accordance with claim 1 wherein said conductive fluid is ink.

8. An electrical connector in accordance with claim 1 wherein said body comprises an ink tube.

9. An electrical connector in accordance with claim 1 wherein at least one of said first and second contact pins comprises a square post.

10. An electrical connector in accordance with claim 1 wherein said first and second pins are adapted for connection to a sensing unit to monitor a presence of fluid in said passageway.

11. An ink monitoring connector assembly comprising:

at least one body comprising a passageway for a flow of a conductive ink fluid;

a first conductive pin having a first portion in fluid communication with said passageway and a second portion external to said body; and a second conductive pin having a first portion in fluid communication with said passageway and a second portion external to said body, wherein an electrical circuit may be established through said conductive ink fluid to carry an electrical signal between said first portions of said first and second conductive pins through said conductive ink fluid when said second portions of said first and second pins are coupled to a sensing unit.

12. An electrical connector in accordance with claim 11 wherein at least one of said first and second conductive pins includes first and second parallel sides, said parallel sides oriented parallel to a direction of flow of said fluid.

13. An electrical connector in accordance with claim 11 wherein at least one of said pins comprises a passageway therethrough for passage of said fluid.

14. An electrical connector in accordance with claim 11 wherein at least one of said first and second pins bifurcates fluid flow through said passageway.

15. An electrical connector in accordance with claim 11 wherein a portion of one of said first and second pins is semi-cylindrical.

16. An electrical connector in accordance with claim 11 wherein at least one of said first and second contact pins comprises a square post.

17. An ink monitoring connector assembly comprising:

a body assembly comprising a plurality of passageways for a flow of a conductive ink fluid; and a first conductive pin and a second conductive pin associated with each passageway of said body assembly, each of said first and second pins including a first portion and a second portion, said first portion in fluid communication with said respective passageway and said second portion external to said body;

wherein an electrical circuit may be established through said conductive ink fluid to carry an electrical signal through said conductive ink fluid between said first portion of said conductive pins corresponding to each passageway of said body assembly when said second portions of said first and second pins are coupled to a sensing unit.

18. An ink monitoring connector assembly in accordance with claim 17 wherein said body assembly comprises a plurality of ink tubes ganged to one another.

19. An ink monitoring connector assembly in accordance with claim 17 wherein at least one of said first and second conductive pins includes first and second parallel sides, said parallel sides oriented parallel to a direction of flow of said fluid.

20. An ink monitoring connector assembly in accordance with claim 17 wherein at least one of said pins comprises a passageway therethrough for passage of said fluid.

21. An ink monitoring connector assembly in accordance with claim 17 wherein at least one of said first and second pins bifurcates fluid flow through said passageway.

22. An electrical connector in accordance with claim 17 wherein a portion of one of said first and second pins is semi-cylindrical.

23. An electrical connector in accordance with claim 17 wherein at least one of said first and second contact pins comprises a square post.

* * * * *